US008961908B1

(12) United States Patent
Bommi

(10) Patent No.: US 8,961,908 B1
(45) Date of Patent: Feb. 24, 2015

(54) MINIATURE WESTERN BLOT MEMBRANE INCUBATION SYSTEM

(71) Applicant: Prashant Bommi, Evanston, IL (US)

(72) Inventor: Prashant Bommi, Evanston, IL (US)

( * ) Notice: Subject to any disclaimer, the term of this patent is extended or adjusted under 35 U.S.C. 154(b) by 0 days.

(21) Appl. No.: 13/645,956

(22) Filed: Oct. 5, 2012

(51) Int. Cl.

| | |
|---|---|
| ***B01L 3/00*** | (2006.01) |
| ***B65D 1/34*** | (2006.01) |
| ***B65D 5/40*** | (2006.01) |
| *B65D 1/24* | (2006.01) |
| *B65D 85/00* | (2006.01) |

(52) U.S. Cl.
CPC ... *B65D 1/34* (2013.01); *B65D 5/40* (2013.01)
USPC ..... 422/551; 422/554; 220/516; 220/810

(58) Field of Classification Search
CPC ..... B65D 5/001; B65D 5/0085; B65D 5/40; B65D 21/0201; B65D 1/35
USPC ..... 422/554
See application file for complete search history.

(56) References Cited

U.S. PATENT DOCUMENTS

| | | | | |
|---|---|---|---|---|
| 4,202,464 | A * | 5/1980 | Mohs et al. | 220/833 |
| 4,819,795 | A * | 4/1989 | Swaney | 206/278 |
| 4,852,560 | A * | 8/1989 | Hermann et al. | 600/575 |
| 4,986,438 | A | 1/1991 | Borst | |
| 5,021,351 | A | 6/1991 | Ervin | |
| 5,392,945 | A * | 2/1995 | Syrek | 220/608 |
| 5,699,925 | A * | 12/1997 | Petruzzi | 220/4.27 |
| 5,730,311 | A * | 3/1998 | Curtis | 220/371 |
| 6,085,930 | A * | 7/2000 | Curtis | 220/371 |
| 6,969,615 | B2 | 11/2005 | Knezevic et al. | |
| 7,449,332 | B2 | 11/2008 | Trammel, II et al. | |
| D631,337 | S | 1/2011 | Prevost | |
| 7,927,012 | B2 | 4/2011 | Harr et al. | |
| 2003/0015132 | A1 | 1/2003 | Carter | |
| 2003/0222020 | A1 * | 12/2003 | Lee et al. | 210/634 |
| 2007/0012710 | A1 * | 1/2007 | Vovan | 220/793 |
| 2012/0048874 | A1 * | 3/2012 | Oakes et al. | 220/839 |
| 2012/0061412 | A1 * | 3/2012 | Vovan | 220/810 |
| 2012/0076565 | A1 * | 3/2012 | Cocchioni | 401/125 |

* cited by examiner

*Primary Examiner* — Jill Warden
*Assistant Examiner* — Brittany Fisher

(57) ABSTRACT

An incubation system for incubating membranes in western blot experiments featuring a base with an inner cavity adapted to hold membranes and small amounts of solutions and a lid that can pivot between an open and closed position to respectively allow and prevent access to the inner cavity. A gasket is disposed in between the lid and base to provide a water-tight seal between the lid and base. The systems can be stacked atop one another to allow for multiple systems to be placed atop a moving platform such as a rocking platform or an orbital shaker.

3 Claims, 8 Drawing Sheets

(ISO View)

(Side View)

(ISO Open View)

(Front View)

(Front View)

(Top View)

(Cross-sectional View)

(Slip Resistant Stacker)

MINIATURE WESTERN BLOT MEMBRANE INCUBATION SYSTEM

BACKGROUND OF THE INVENTION

Western blot protocols require the incubation of membranes in blocking solutions and antibody solutions. Antibodies are expensive reagents. The present invention features a novel incubation system (container) for incubating western blot membranes in very small amounts of solution. The system (container) allows for a reduction in the typical amount of antibody solution that is used and can allow the antibody solution to be easily reused for subsequent membrane incubations. The system (container) itself is also reusable.

An important feature of the system (container) of the present invention is its all depth (e.g., inner cavity of 0.3 cm) and its water-tight seal between the base and the lid. The length and width of the container can be customized as per requirement (e.g., 5 cm by 1 cm, 8 cm by 2 cm, 9 cm by 3 cm, etc., the length and width are not limited to the dimensions described herein). In some embodiments, the quantity of liquid antibody cocktail needed to incubate the western blot membrane is not more than ⅓ or ¼ of the total volume of the inner cavity. For example, in some embodiments, if the dimensions of the inner cavity are 6 cm by 3 cm by 0.3 cm, then the volume of the inner cavity is 5.4 cubic cm and the volume of antibody cocktail required is 1.8 ml (1.8 cc), which is ⅓ of the volume of the inner cavity. As a comparison, a traditional western blot tray may require about 10 ml of antibody cocktail. Thus, the system (container) of the present invention can help save a great deal of antibody (and money) as compared to a traditional western blot tray (e.g., antibodies may cost approximately $3 per microliter). Also, from an environmental perspective, this system (container) uses less plastic material and can minimize plastic pollution and the burden on landfills.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 78 shows an example of a rocking platform.

DESCRIPTION OF PREFERRED EMBODIMENTS

Figure 1:
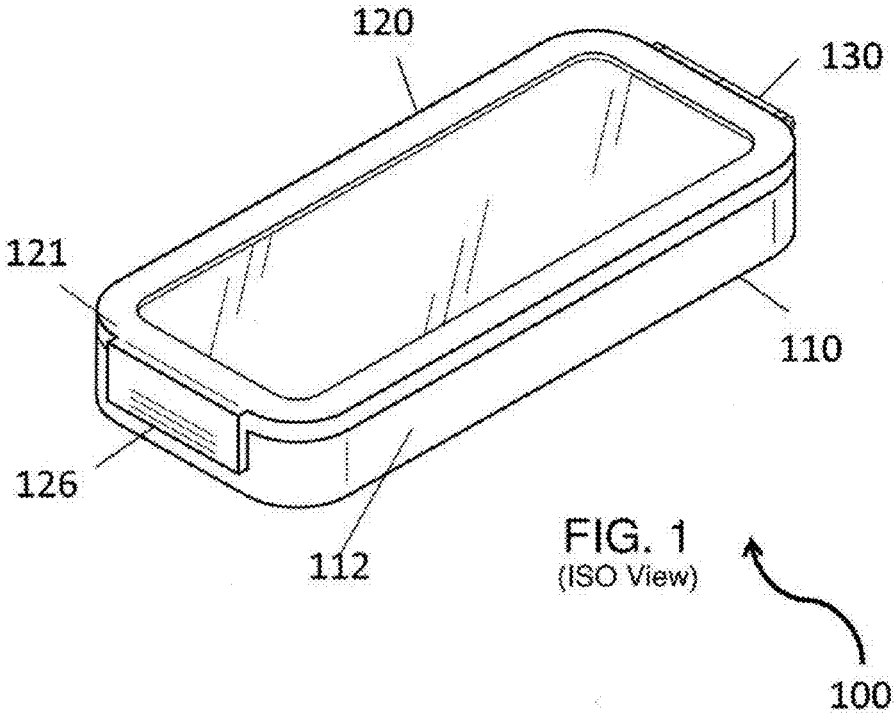
FIG. 1 is a perspective view of the system of the present invention.

The present invention features a small, shallow western blot incubating container designed to greatly reduce the amount of primary and secondary antibody solution (which is very expensive) required to reveal target proteins on the membrane. The container may be produced of low-binding autoclavable plastic (e.g., black for the base, clear for the lid). The inner cavity of the container may be 0.3 cm deep. The width versus height of the container may measure 1 cm by 5 cm wide, 3 cm by 9 cm, 2 cm by 8 cm, etc. The base and lid may feature a rim that may measure about 1 cm. A narrow band of sealant (e.g., gasket) may be attached to the rim of the base to achieve a watertight seal when the lid is closed. The lid and base may be attached (e.g., at the narrow end of the container) by a snap hinge or two snap hinges. The lid may snap closed at the opposite end with a conventional snap closure.

The shallow inner cavity of the container (as compared to traditional trays) may help save money by using less primary and secondary antibody solutions. The small size of the containers and ability to stack containers may also enable a researcher to perform more tests at the same time (e.g., more than one container (system) may be placed and stacked on an orbital shaker or rotating platform to be agitated simultaneously, saving time and increasing productivity). The small nature of the container (system) requires less plastic for construction (as compared to traditional trays) thus the container is more environmentally friendly.

Referring now to FIG. 1-8, the present invention features a western blot membrane incubation system (100) for incubating membranes in small amounts of solution. The system (100) of the present invention, or a combination of systems (100), can be used on moving platforms, for example a rocking platform (750), an orbital shaker (710), or any other appropriate surface.

The system (100) comprises containers that each comprise a base (110) having raised side walls (112), a bottom surface (116), and an inner cavity (118) formed by the raised side walls (112) around the perimeter of the bottom surface (116). The inner cavity (118) is adapted to hold solutions and western blot membranes. The inner cavity (118) is not limited to holding solutions and western blot membranes.

The raised side walls (112) extend a first distance above the bottom surface (116) of the base (110). The raised side walls (112) have a top, edge (113). The first distance refers to the distance between the top edge (113) of the side walls (112) and the bottom surface (116) of the base (110), e.g., the surface of the bottom surface (116) facing the inner cavity (118).

In some embodiments, the first distance is about 0.3 cm. In, some embodiments, the first distance is between about 0.1 to 0.3 cm. In some embodiments the first distance is between about 0.2 to 0.3 cm. In some embodiments, the first distance is between about 0.25 to 0.3 cm. The first distance is not limited to the aforementioned measurements.

Figure 2:
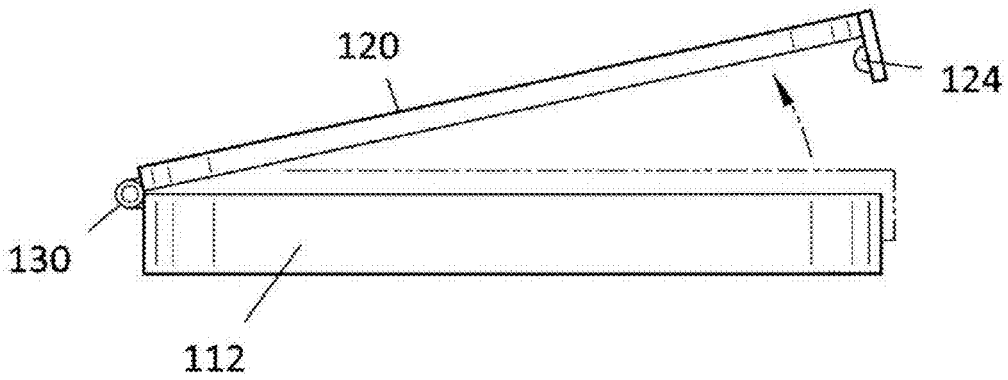
FIG. 2 is a side view of the system of the present invention.

The system (100) further comprises a lid (120) for enclosing the inner cavity (118). In some embodiments, the lid (120) is removably attachable to the base (110). In some embodiments, the lid (120) is pivotally attached to the base (110). For example, as shown in FIG. 2, in some embodiments, the lid (120) is pivotally attached to the top edge (113) of a side wall (112) of the base (110) (e.g., the "hinge side wall") via a hinge (130). The lid (120) can pivot between at least an open position and a closed position respectively allowing and preventing access to the inner cavity (118). In the closed position, the lid (120) seals off the inner cavity (11

Disposed around the entire perimeter of the side walls (112) in the top edge (113) of the side walls (112) is a gasket (140). Gaskets are well known to one of ordinary skill in the art. The gasket (140) functions to create a water-tight seal between the top edge (113) of the side walls (113) and the lid (120).

Figure 3:
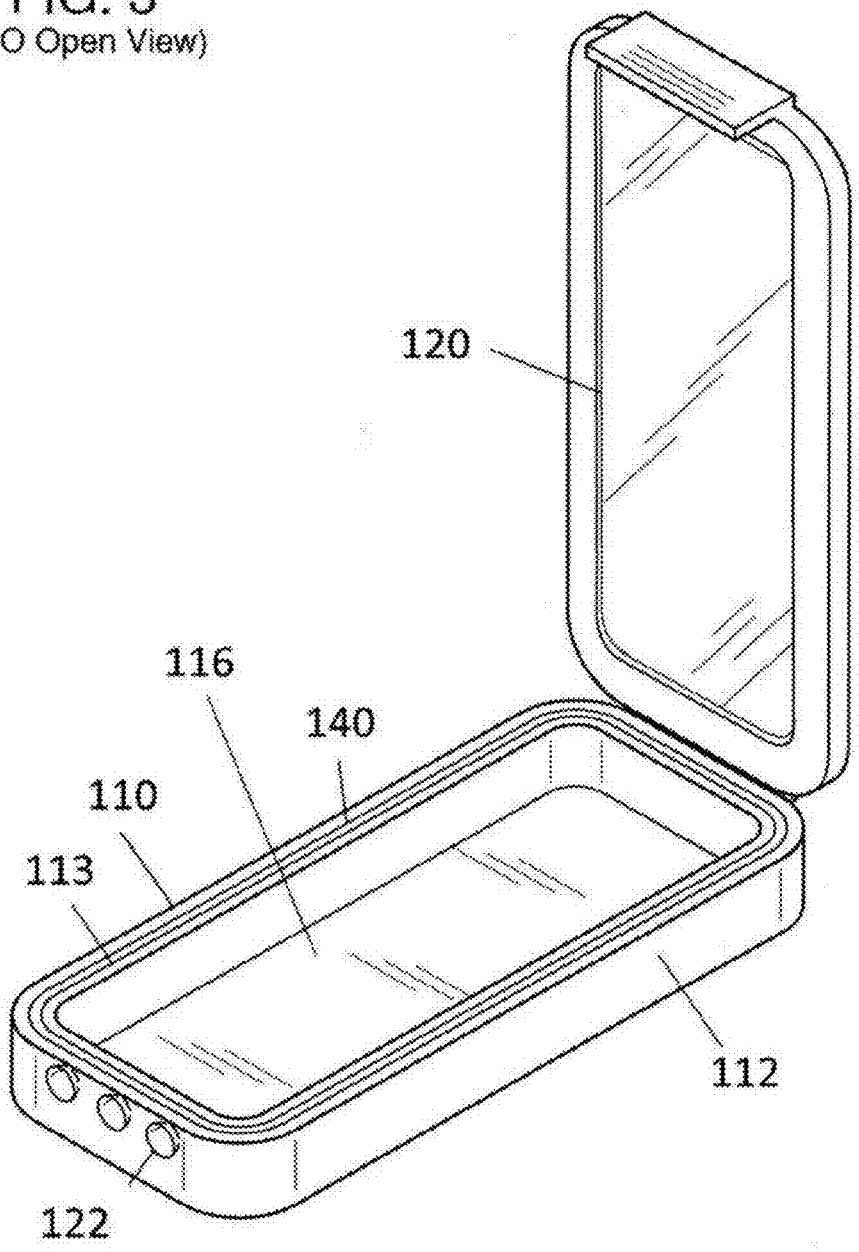
FIG. 3 is a perspective view of the system of the present invention.

The system (100) further comprises a locking means for securing the lid (120) in the closed position. In some embodiments, the locking means comprises a first half locking means disposed on the base (110) and a second half locking means disposed on the lid (120), wherein the first half locking means and second half locking means engage each other to secure the lid (120) in the closed position. In some embodiments, the first half locking means and second half locking means are disposed on the base and lid, respectively, opposite the hinge (130). In some embodiments, the locking means comprises a snap mechanism, a latch mechanism, a clasp mechanism, a magnet mechanism, the like, or a combination thereof. As shown in FIG. 2 and FIG. 3, in some embodiments, the first half locking means comprises a plurality of indentations (122) disposed in the outer surface of a side wall (112) (e.g., "a locking side wall"), and the second half locking means comprises a plurality of tabs (124) extending outwardly from a flange (126) that extends downwardly from a side edge (121) of the lid (120). The tabs (124) can temporarily slide into the indentations (122) to secure the lid (120) in the closed position. The locking means is not limited to the aforementioned examples.

Figure 4:
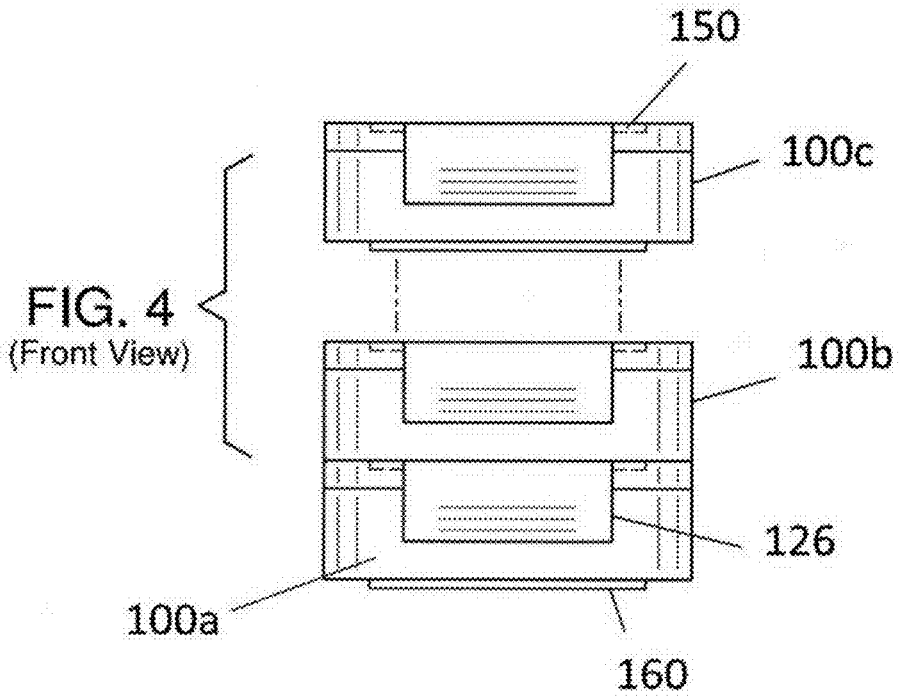
FIG. 4 is a front view of the system of the present invention.
Figure 4A:
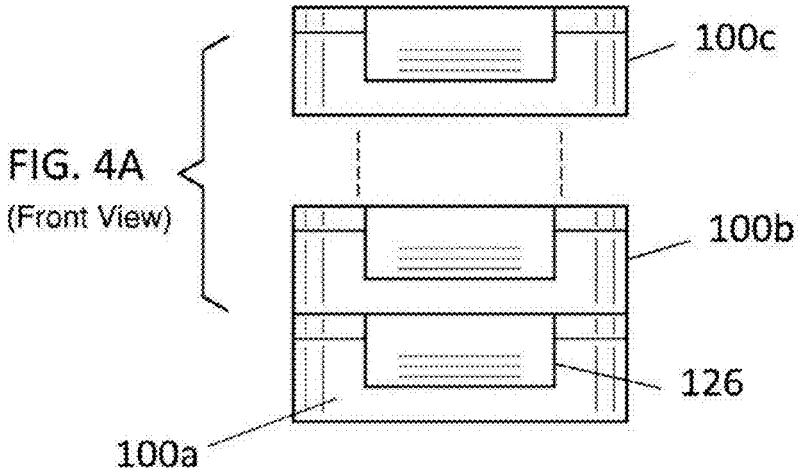
FIG. 4A is a front view of an alternative embodiment of the present invention.
Figure 5:
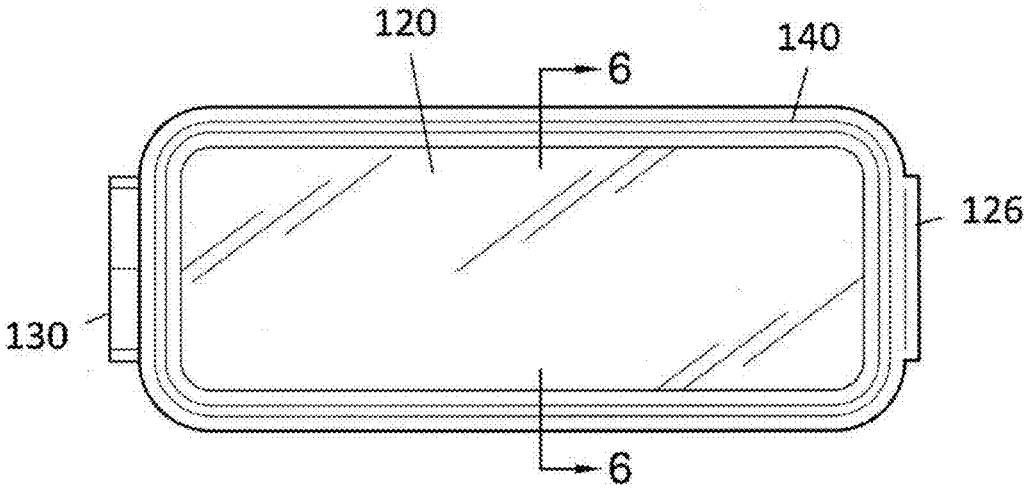
FIG. 5 is a top view of the system of the present invention.
Figure 6:
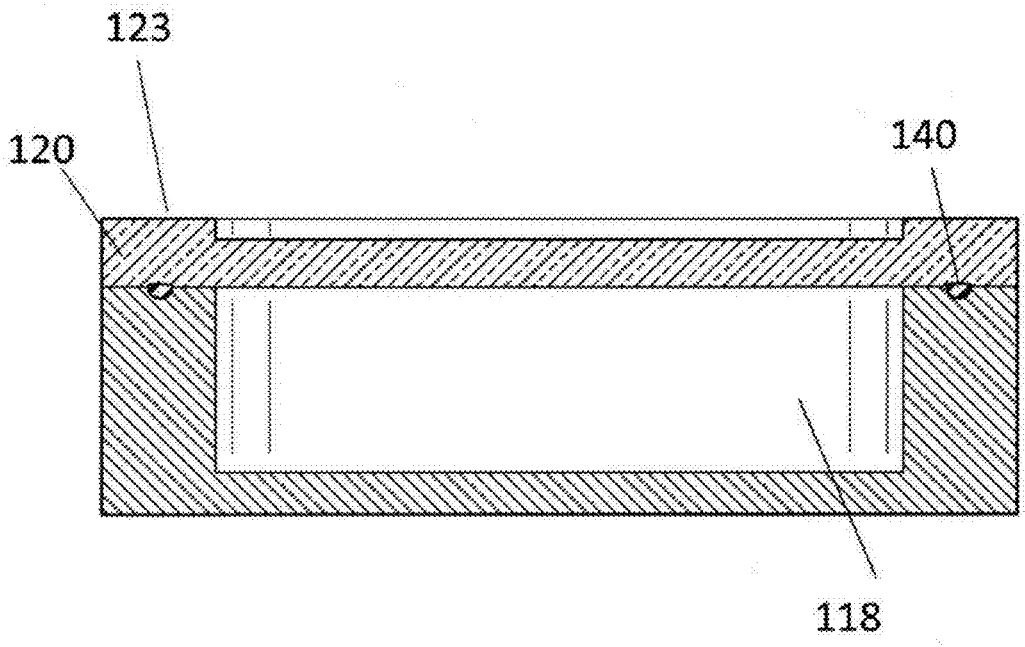
FIG. 6 is a cross sectional view of the system of the present invention.
Figure 7A:
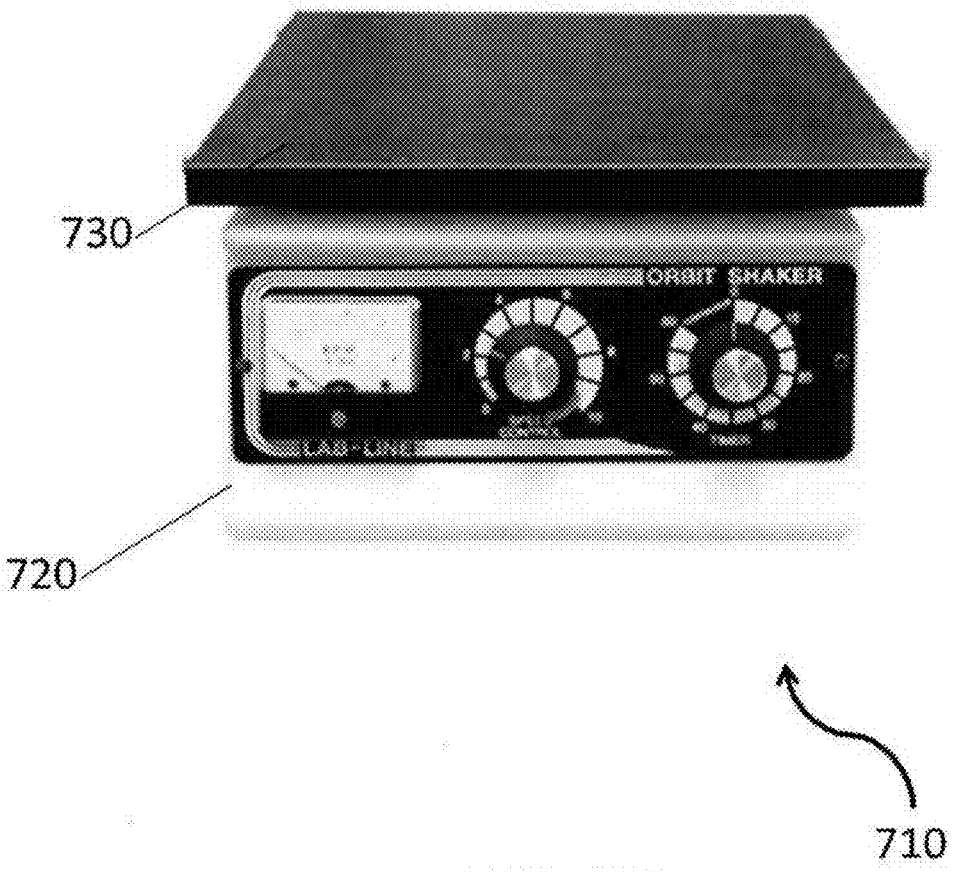
FIG. 7A shows an example of an orbital shaker.
Figure 7B:
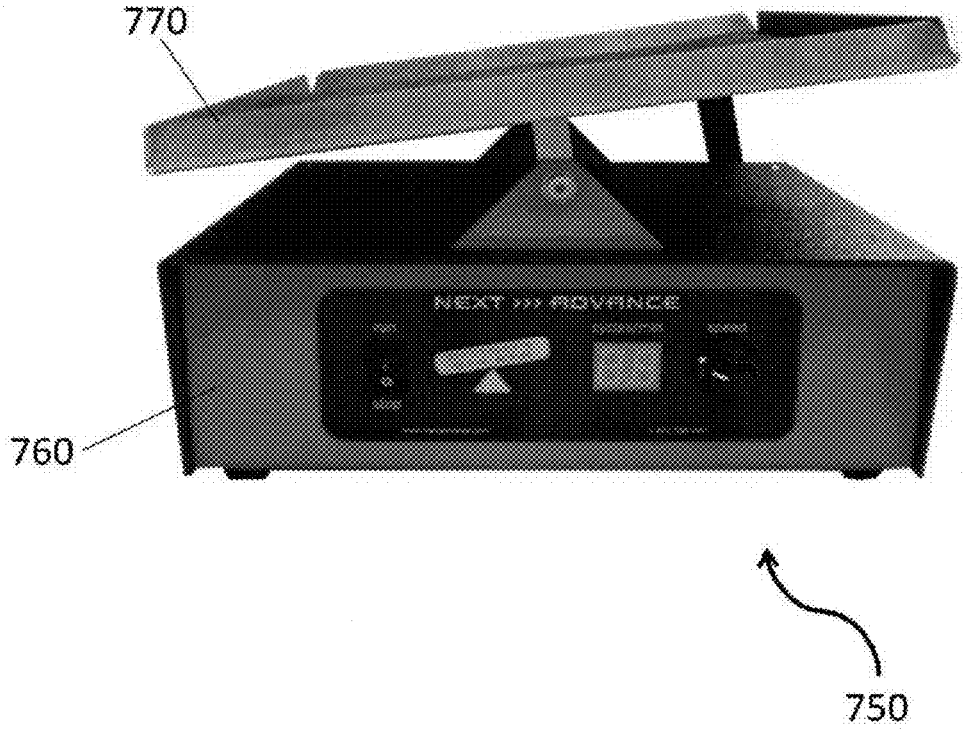

In some embodiments, the system (100) is designed to be stackable. Since the containers are stackable, multiple membranes can be placed on a platform (e.g., orbital shaker, rocking platform) at a time. This can enhance productivity for individuals and allow multiple lab members to share the same platform. For example, as shown in FIG. 4, in some embodiments, a first system (100*a*) is placed on a surface, e.g., a moving surface such as an orbital shaker (710) or a rocking platform (750), and a second system (100*b*) is placed atop the first system (100*a*). In some embodiments, a third system (100*c*) is placed atop the second system (100*b*). A user may stack as many systems as desired, for example two, three, four, five, six, etc. (multiple containers are stacked in FIG. 4 and FIG. 4A).

As shown in FIG. 4, in some embodiments, a stacking slot (150) (e.g., indentation) is disposed in the top surface (123) of the lid (120). In some embodiments, a stacking tab (180) extends downwardly from the bottom surface (116) of the base (110). The stacking slot (150) of a first system (100*a*) is adapted to accept the stacking tab (160) of a second system (100*b*) such that the second system (100*b*) can be stacked atop the first system (100*a*) as shown in FIG. 4.

In some embodiments, the bottom surface (116) of the base (110) and/or the stacking tab (160) comprise a gripping component to prevent the base (110) from slipping when placed on a surface such as a table, rocking platform (750), orbital shaker (710), and/or the like.

Figure 8:
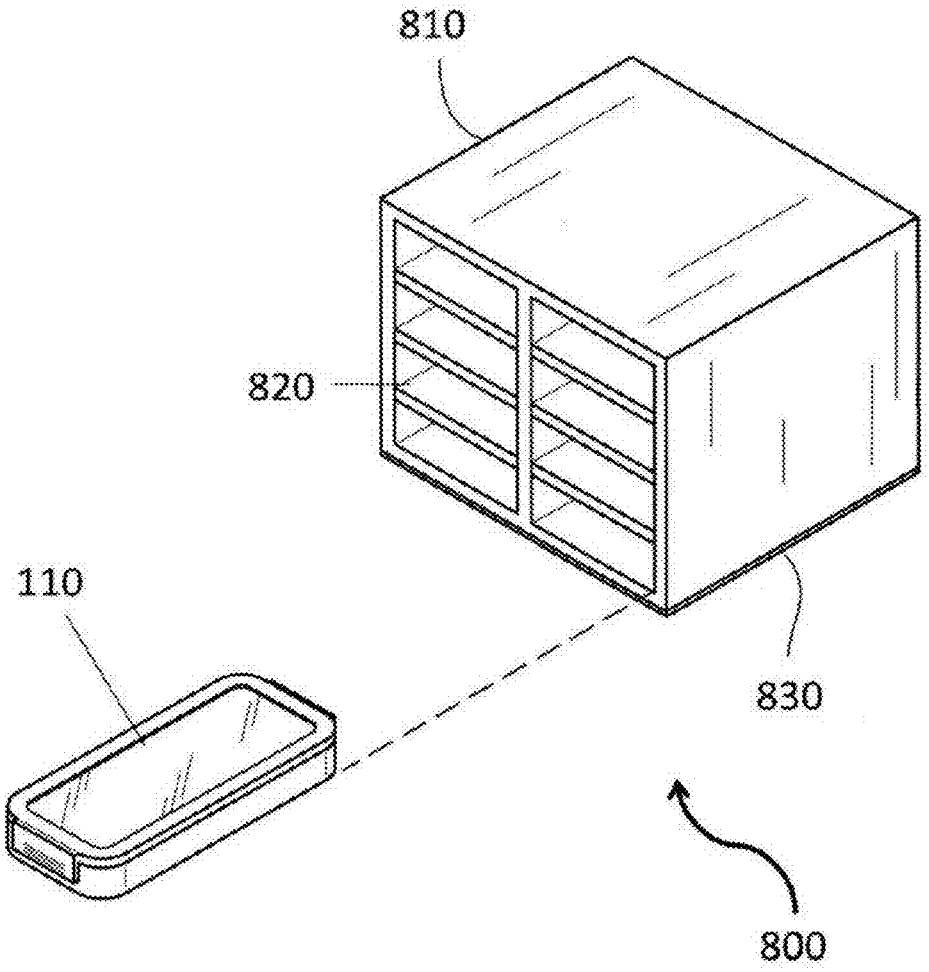
FIG. 8 is a perspective view of a slip-resistant stacker for holding a plurality of systems (containers) of the present invention.

As shown in FIG. 8, the present invention also features a slip-resistant stacker system (800) for holding a plurality of systems (100) (containers). The stacker system (800) comprises a housing (810) having an inner cavity adapted to hold multiple containers/bases (110). For example, a plurality of slots (820) is disposed in the housing (810), each slot (820) being adapted to hold a base (110). The slots (820) may be stacked atop one another and aligned as shown in FIG. 8. In some embodiments, the housing (810) comprises multiple columns of slots (820). For example, as shown in FIG. 8, the housing (810) may comprise two columns of slots (820). In some embodiments, the columns comprise between 2 to 6 slots (820). The present invention is not limited to the aforementioned size and configuration of the stacker system (800).

In some embodiments, a gripping component (830) is disposed on a bottom surface of the housing (810) to help prevent the system (800) from slipping on an orbital shaker or rocking platform.

The system (100) of the present invention may be constructed in a variety of sizes. In some embodiments, the size of the system (100) is custom-designed. In some embodiments, the base (110) is about 9 cm in length as measured from a first end to a second end, e.g., the hinge side wall to the locking side wall. In some embodiments, the base (110) is about 8 cm in length as measured from a first end to a second end, e.g., the hinge side wall to the locking side wall. In some embodiments, the base (110) is between about 8 to 10 cm in length as measured from a first end to a second end, e.g., the hinge side wall to the locking side wall. In some embodiments, the base (110) is between about 5 to 15 cm in length as measured from a first end to a second end, e.g., the hinge side wall to the locking side wall. The system (100) is not limited to the aforementioned lengths.

The system (100) may be constructed from a variety of materials. For example, in some embodiments, the system (100) may be constructed from a material comprising plastic, rubber, the like, or a combination thereof. In some embodiments, the base (110) or a portion of the base (110) is clear, translucent, or transparent. In some embodiments, the lid (120) or a portion of the lid (120) is clear, translucent, or transparent.

In some embodiments, the system (100) comprises a moving platform, e.g., a molecular biology rocking platform (750) or a molecular biology orbital shaker (710), on which, the base (110) is mounted, e.g., placed, removably attached, etc. For example, in some embodiments, the molecular biology orbital shaker (710) comprises a stationary base (720) and a moving base (730) rotatably attached atop the stationary base (720) via an attachment point, wherein the moving base (730) rotates 360 degrees about the attachment point such that the moving base (730) moves in a circular direction when viewed from above. The base (110) may be placed atop the moving base (730) of the orbital shaker (710). In some embodiments, the molecular biology rocking platform (750) comprises a stationary base (760) and a see saw base (770) pivotally attached (optionally pivotally and rotatably attached) atop the stationary base (760) via a pivot point, wherein the see saw base (770) pivots in a first direction and a second opposite direction about the attachment point such that the see saw base (770) moves in a see saw motion when viewed from a side. The base (110) may be placed atop the see saw base (770).

As used herein, the term "about" refers to plus or minus 10% of the referenced number.

The disclosures of the following U.S. patents are incorporated in their entirety by reference herein: U.S. Pat. Application No. 200310015132; U.S. Pat. No. 7,449,332; U.S. Pat. No. 7,927,012; U.S. Pat. No. 6,969,615; U.S. Pat. No. 5,021,351; U.S. Pat. No. 4,202,464; U.S. Pat. No. 4,986,436; U.S. Design Pat. No. D631,337.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A western blot membrane incubation system (100) for incubating a western blot membrane in a solution, said western blot membrane incubation system (100) consisting of a plurality of rectangular containers stacked on top of each other, wherein each container consists of:

(a) a base (110) consisting of a bottom surface (116) and raised side walls (112) extending around a perimeter of the bottom surface (116), the bottom surface (116) and side walls (112) together form an inner cavity (118), wherein a top edge (113) of the side walls (112) extends a first distance above the bottom surface (116) of the base (110), the first distance is between about 0.1 to 0.3 cm;

(b) a lid (120) pivotally attached to a side wall (112) of the base (110) via a hinge (130), the lid (120) can pivot between at least an open position and a closed position respectively allowing and preventing access to the inner cavity (118), in the closed position the lid (120) seals off the inner cavity (118);

(c) a gasket (140) disposed in the top edge (113) of the side walls (112) of the base (110) extending around a perimeter of the side walls (112), the gasket (140) creates a water-tight seal between the top edge (113) of the side walls (112) and the lid (120) when the lid (120) is in the closed position;

(d) a locking means consisting of a first half locking means disposed on the base (110) and a second half locking means disposed on the lid (120), wherein the first half locking means and second half locking means engage each other to secure the lid (120) in the closed position; and (e) a stacking slot (150) disposed in a portion of the top surface (123) of the lid (120) and a stacking tab (160) extending downwardly from a portion of the bottom surface (116) of the base (110), the stacking slot (150) is adapted to accept a stacking tab (160) of a second system (100*b*) such that a second system (100*b*) can be stacked atop a first system (100*a*);

wherein the first distance from the top edge (113) of the side walls (112) to the bottom surface (116) of the base (110) is between about 0.1 to 0.3 cm;

wherein the first half locking means consists of three indentations (122) disposed in an outer surface of a side wall (112) and the second half locking means consists of three tabs (124) extending outwardly from a flange (126) that extends downwardly from a side edge (121) of the lid (120), wherein the tabs (124) temporarily slide into the indentations (122) to secure the lid (120) in the closed position, and wherein the tabs (124) slide out of the indentations (120) to allow for the lid to pivot into the open position.

2. The system (100) of claim 1, wherein the bottom surface (116) of the base (110) consists of a gripping component to prevent the base (110) from slipping.

3. The system (100) of claim 1, wherein the stacking tab (160) consists of a gripping component to prevent the base (110) from slipping.

* * * * *